US006955230B2

(12) United States Patent
Meixner

(10) Patent No.: US 6,955,230 B2
(45) Date of Patent: Oct. 18, 2005

(54) HAMMER DRILL AND/OR CHIPPING HAMMER

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,144

(22) PCT Filed: Feb. 14, 2002

(86) PCT No.: PCT/DE02/00521

§ 371 (c)(1),
(2), (4) Date: Dec. 3, 2002

(87) PCT Pub. No.: WO02/087830

PCT Pub. Date: Nov. 7, 2002

(65) Prior Publication Data

US 2003/0132015 A1 Jul. 17, 2003

(30) Foreign Application Priority Data

Apr. 28, 2001 (DE) ..... 100 21 088

(51) Int. Cl.[7] ..... B25D 17/00
(52) U.S. Cl. ..... 173/201; 173/114; 173/122
(58) Field of Search ..... 173/48, 114, 117, 173/118, 122, 201

(56) References Cited

U.S. PATENT DOCUMENTS 3,847,229 A * 11/1974 Wanner et al. ..... 173/48
4,750,567 A * 6/1988 Grossmann et al. ..... 173/13
5,111,890 A 5/1992 Ranger
5,435,397 A * 7/1995 Demuth ..... 173/109
5,816,341 A * 10/1998 Bone et al. ..... 173/48
5,975,217 A 11/1999 Frenzel et al.
6,523,622 B1 * 2/2003 Berger et al. ..... 173/212

FOREIGN PATENT DOCUMENTS

EP 0 775 556 A 5/1997

* cited by examiner

*Primary Examiner*—Louis K. Huynh
*Assistant Examiner*—Nathaniel Chukwurah
(74) *Attorney, Agent, or Firm*—Michael J. Striker

(57) ABSTRACT

The invention is based on a hand power tool, in particular a drill- and/or chipping hammer, comprising a striking mechanism (10) that has a drivable pot-type piston (12) with at least one idle opening (14).

It is proposed that the idle opening (14) is capable of being closed via a controllable, separate closing element (16).

10 Claims, 3 Drawing Sheets

HAMMER DRILL AND/OR CHIPPING HAMMER

BACKGROUND OF THE INVENTION

The invention is based on a drill—and/or chipping hammer.

Drill—and/or chipping hammers having a striking mechanism are known that comprise a drivable pot-type piston having at least one idle opening.

If the drill—and/or chipping hammer is pressed—with a tool—against a surface to be worked, a striker moves in the direction of the idle opening, so that, in a working position, a rear edge of the striker covers the idle opening. This closes said idle opening, and an air cushion located in the pot-type piston is compressed by means of an axial motion of the pot-type piston in the direction of operation and by means of inertia of the striker that is moveable in the pot-type piston. When the compressed air cushion expands, the striker is accelerated in the direction of a tool mount and strikes a punch dolly that drives a tool situated in the tool mount.

When a short structural design is involved, in order to prevent the idle opening from opening uncontrollably in the working position, the idle opening would be ideally located—in the axial direction—in an anterior region of the pot-type piston closest to the tool mount, so that, during operation in the striking mode, the rear edge of the striker or the striker itself always keeps the idle opening closed and it is prevented from opening unintentionally.

When a short structural design is involved, in order to ensure reliable and rapid opening of the idle opening with few idle strokes of the striking mechanism when an idle position is reached, the idle opening—on the other hand—would be ideally located—in the axial direction—in a posterior region of the pot-type piston furthest away from the tool mount, so that the rear edge of the striker is always located in front of the idle opening in the direction of a base of the pot-type piston, and said idle opening remains open at all times.

In order to fulfull both objectives to the greatest extent possible, the idle opening is located—in practice—in a position between the two individual ideal states.

SUMMARY OF THE INVENTION

The invention is based on a power hand tool, in particular a drill—and/or chipping hammer, comprising a striking mechanism that has a drivable pot-type piston with at least one idle opening.

It is proposed that the idle opening is capable of being closed via a controllable, separate closing element. When a short structural design is involved, the idle opening can be advantageously located in a region of the pot-type piston furthest away from a tool mount. A rapid, flexible, and exact control of the striking mechanism is obtainable, and an occurrence of uncontrolled opening during operation in the striking mode or in a working position can be reliably prevented. The idle opening can be opened completely by the closing element immediately after an idle position is reached, and the idle opening can be held open in the idle position at all times, so that an undesired build-up of a compressed air cushion is avoidable and no-load strokes induced as a result can be prevented.

Advantageously, the closing element is moved together with the pot-type piston in the direction of operation of the pot-type piston. Relative motion—and friction associated therewith—between the closing element and the pot-type piston can therefore be prevented. It is also feasible that the separate closing element is situated in the housing in a stationary fashion and is designed to glide on the pot-type piston, by way of which moving masses can be prevented as well.

If the closing element is mechanically controlled, a device that is structurally simple, cost-effective and insensitive to contamination. Basically, however, other controls appearing reasonable to one skilled in the art are feasible, such as electrical and/or electromagnetic controls having electrical and/or electromagnetic actuators. A particularly lightweight structure can be obtained using an electromagnetic valve in particular, and operator comfort can be enhanced.

Particularly advantageously, the closing element is loaded with a spring element in the direction of its closed position, and it can be moved into its open position by means of a mechanical indexing device. With the spring element and the mechanical indexing device, a simple, space-saving and reliable mechanism can be obtained that can be produced cost-effectively and robustly. Furthermore, friction between an indexing element and the closing element—and the reduced output resulting therefrom—can be prevented in the working position in particular. In the idle position only, the closing element can be advantageously guided along an indexing element and held in its open position. Other indexing devices appearing reasonable to one skilled in the art are feasible as well, e.g., having a control cam, via which the closing element is opened and closed, etc.

The closing element is furthermore advantageously fastened to the spring element. Additional components, installation space and assembly costs can be spared as a result.

If the indexing element is adjustable radially in relation to the pot-type piston via at least one adjusting element, and the closing element can be controlled in this fashion, a large radial distance and, therefore a rapid opening of the idle opening can be advantageously obtained using a small axial distance, when a short structural design is involved. It is also feasible, however, that the indexing element is situated in the housing in a stationary fashion—at least in the radial direction—and the closing element can be controlled via a control cam integrally molded on the indexing element, by way of which a movement of the indexing element in the radial direction and a bearing designed for this could be avoided.

Advantageously, the indexing element is supported such that it is displaceable in the direction of operation of the pot-type piston against a spring force of a spring element. The spring element can bear against a wall of the housing of the power hand tool in the direction of operation, and it can act in the direction of operation. When the idle position is reached, a rapid opening of the closing element can be easily achieved, and the operating method of an idle spring that is present can be supported or replaced entirely. Instead of a translational motion in the direction of operation, the indexing element could also be designed only to pivot.

If the motion of the indexing element is supported via roller bearings, dynamic friction between the indexing element and the adjusting element can be prevented. Other bearing elements appearing suitable to one skilled in the art are feasible as well, such as sliding blocks.

Particularly advantageously, the closing element is made of a flexible material. As a result, the closing element can advantageously adapt to the pot-type piston, and an advantageous sealing effect can be obtained.

The means of attaining the object according to the invention can basically be used with all drill-and/or chipping hammers comprising a pot-type piston, but it is used particularly advantageously with drill-and/or chipping hammers over 5 kg in weight. With the pot-type piston, an advantageous start-up behavior can be achieved, in particular due to a frictional connection between the pot-type piston and the striker in the case of heavy drill-and/or chipping hammers. Moreover, the striker comes to rest quickly due to its usually large mass, despite the presence of frictional forces between the pot-type piston and the striker after an idle position is reached.

Further advantages result from the following description of the drawings. An exemplary embodiment of the invention is presented in the drawings. The drawing, the description, and the claims contain numerous features in combination. One skilled in the art will advantageously consider them individually as well and combine them into reasonable further combinations.

DESCRIPTION OF THE PREFERRED EMBODIMENTS

Figure 1:
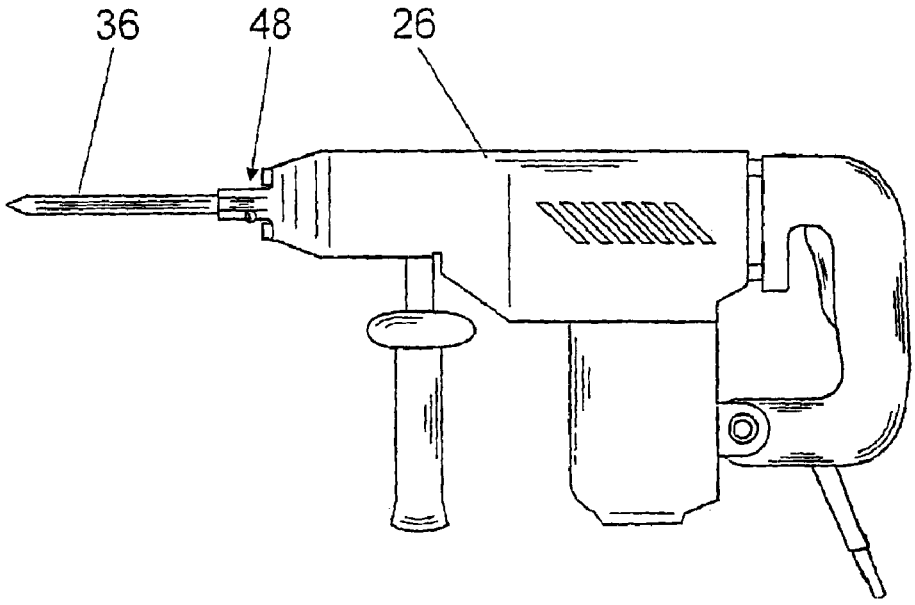
FIG. 1 shows a side view of a chipping hammer.

FIG. 1 shows a chipping hammer comprising a tool mount 48 for accommodating a tool 36 capable of being driven in a striking manner.

A not-further-shown electric motor is interconnected with an eccentric 28 for driving purposes via a drive shaft in a housing 26 of the chipping hammer. The eccentric 28 is interconnected with a striking mechanism 10 that comprises a drivable pot-type piston 12 with an idle opening 14 located in the region behind the pot-type piston 12. The idle opening 14 can be closed via a controllable, separate closing element 16.

Figure 2:
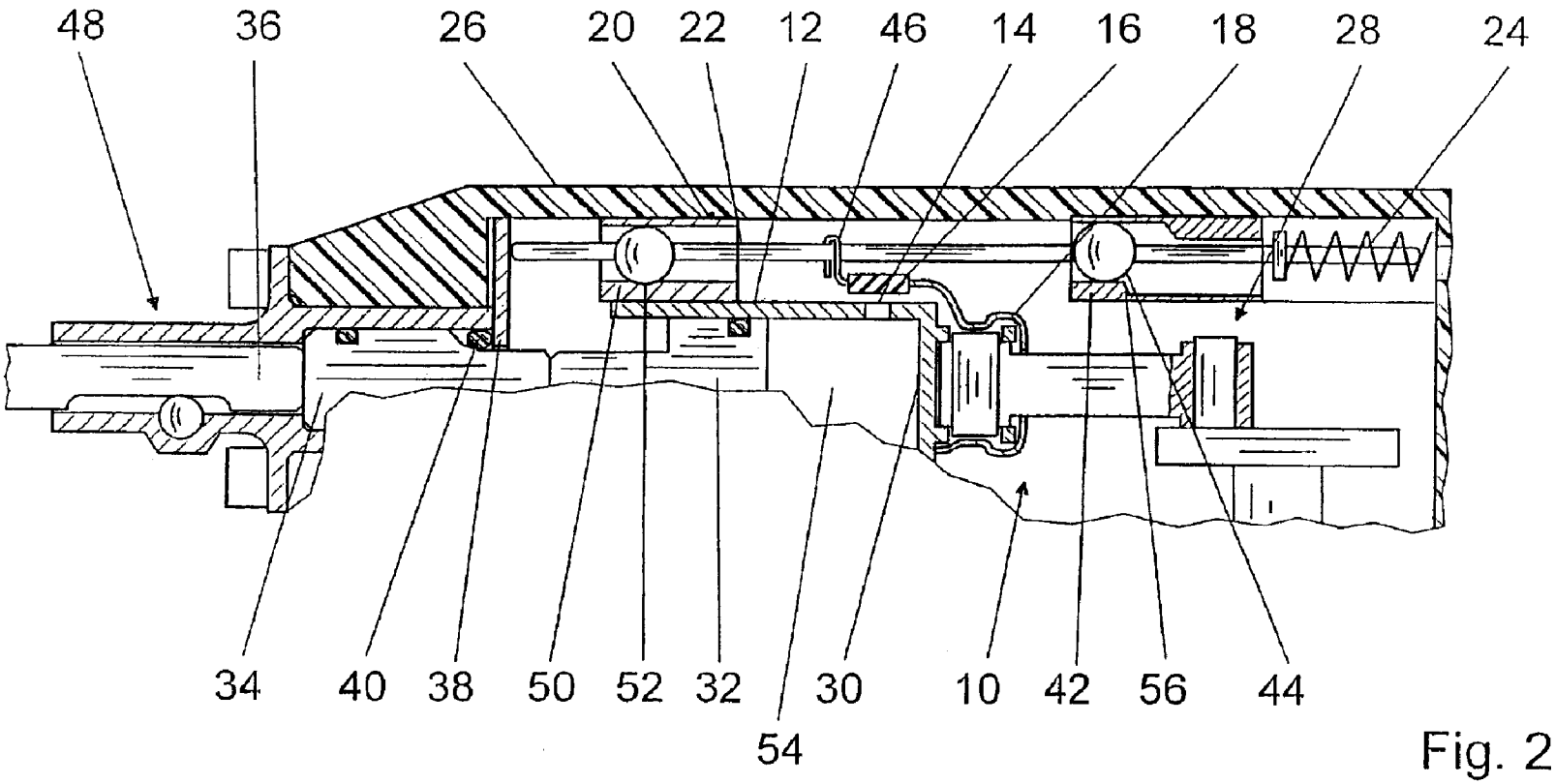
FIG. 2 shows a partial sectional view through the chipping hammer in FIG. 1 in an idle position.

In an idle position, the tool 36, a striking pin 34, and a striker 32 are located in an anterior position in the direction of operation. An indexing device 20 bears against the striking pin 34 in the direction of operation via a disk 38 and via a rubber ring 40 and, against the direction of operation, it bears against the housing 26 of the chipping hammer with a spring element 24. The indexing device 20 comprises an indexing element 22 that is supported such that it is displaceable against a spring force of the spring element 24 (FIG. 2).

The spring force of the spring element 24 acts in the direction of operation and presses the indexing element 22—designed as a rod and the movement of which is supported by rolling elements 44, 52—in the direction of the tool mount 48. The rolling elements 44, 52 roll on adjusting elements 42, 50 and hold the indexing element 22 in a radially outward position in relation to the pot-type piston 12. In the idle position, the mechanically controlled closing element 16 is guided with a side closest to the tool mount 48 via an eyelet 46 on the indexing element 22 and, as a result, it is held in a radially outward position or in the open position. The idle position 14 is opened (FIG. 2).

The closing element 16 is fastened to an outer side of the pot-type piston 12 with a clasp-like spring element 18 made of spring steel sheet on a side furthest away from the tool mount 48. The closing element 16 and the spring element 18 are moved together in the direction of operation of the pot-type piston 12.

Figure 3:
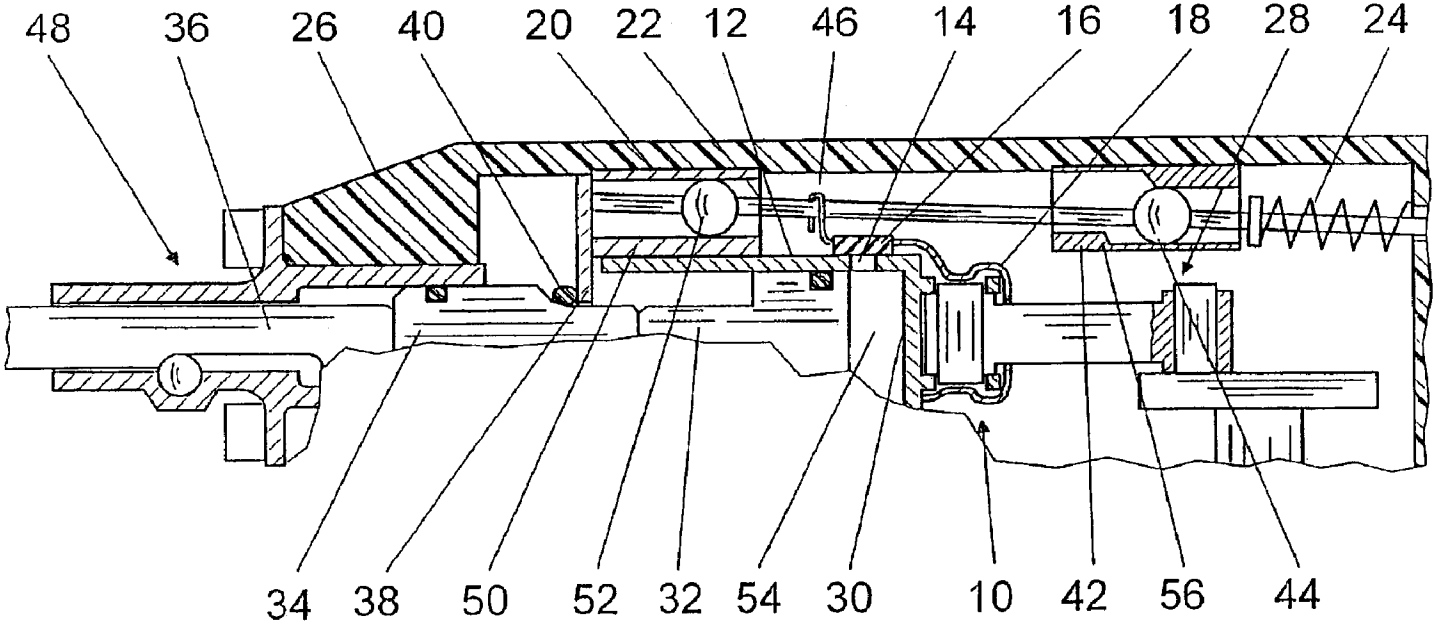
FIG. 3 shows the partial sectional view according to FIG. 2 in a working position.

If an operator presses the tool 36 in the direction of operation against an object to be worked, the tool 36 moves in the housing 26 of the chipping hammer against the direction of operation. The indexing device 20 is moved via the striking pin 34, the rubber ring 40 and the disk 38 against the direction of operation and against the spring force of the spring element 24. The rolling elements 44, 52 of the indexing element 22 roll in the adjusting elements 42, 50. With the adjusting element 42 that is posterior to or furthest away from the tool mount 48, the indexing element 22 is displaceable radially in relation to the pot-type piston 12 via the rolling element 44. The rolling element 44 moves radially in the adjusting element 42 along a step 56 or control edge in the direction of the pot-type piston 12, and the indexing element 22 of the indexing device 20 tilts—with its end furthest away from the tool mount 48—in the radial direction toward the pot-type piston 12 (FIG. 3). It is also feasible, in principle, for the anterior adjusting element 50 closest to the tool mount 48 to actively move the indexing element 22 radially outwardly and inwardly, so that the indexing element 22 undergoes parallel displacement.

The closing element 16—which is made of rubber and is loaded with the clamp-like spring element 18 in the direction of its closed position—moves in the radial direction toward the pot-type pistoon 12 and closes the idle opening 14. The striking mechanism 10 is situated in its working position. The indexing device 20 is held in the working position against the spring force of the spring element 24 by means of the operator's contact force via the tool 36, the striking pin 34, the rubber ring 40, and the disk 38 (FIG. 3). As a result of the tilting motion of the indexing element 22, contact between the eyelet 46 and the indexing element 22 is eliminated, and friction between the eyelet 46 and the indexing element 22 in the working position is prevented.

With an axial motion of the pot-type piston 12 in the direction of operation and due to inertia of the striker 32, an air cushion 54 is compressed between the base of the pot-type piston 30 and the striker 32. Expansion of the air cushion 54 accelerates the striker 32 in the direction of the tool mount 48, whereby the striker 32 drives the tool 36 in a striking manner via the striking pin 34.

If the operator moves the housing 26 or the chipping hammer against the direction of operation away from the work piece to be worked, the spring element 24 of the indexing device 20 presses the indexing element 22 with its spring force in the direction of operation. The striking pin 34 is pushed into its idle position via the indexing element 22, the disk 38, and the rubber ring 40. The spring element 24 serves as an idle spring, whereby an additional idle spring could basically be provided as well to support the spring element 24. Additionally, the action of the spring element 24 is supported by a no-load stroke of the striker 32 and thereby drives the striking pin 34 out of its working position and into its idle position (FIG. 2).

When the indexing element 22 moves in the direction of operation, the rolling elements 44, 52 roll in the adjusting elements 42, 50. Rolling element 44 moves radially outwardly in the posterior adjusting element 42 along the step 56, and the indexing element 22 pivots radially outwardly with its posterior end. The pivoting motion of the indexing element 22 causes the closing element 16 to be guided via the eyelet 46 radially outwardly—against the spring force of the spring element 18—into its open position.

An air cushion 54 that may be present in the pot-type piston 12 can escape, and a build-up of a compressed air cushion 54 can be reliably prevented. The idle position is reached (FIG. 2).

| Reference Numerals | |
|---|---|
| 10 | Striking mechanism |
| 12 | Pot-type piston |
| 14 | Idle opening |
| 16 | Closing element |

-continued

| Reference Numerals | |
|---|---|
| 18 | Spring element |
| 20 | Indexing device |
| 22 | Indexing element |
| 24 | Spring element |
| 26 | Housing |
| 28 | Eccentric |
| 30 | Base of pot-type piston |
| 32 | Striker |
| 34 | Striking pin |
| 36 | Tool |
| 38 | Disk |
| 40 | Rubber ring |
| 42 | Adjusting element |
| 44 | Rolling element |
| 46 | Eyelet |
| 48 | Tool mount |
| 50 | Adjusting element |
| 52 | Rolling element |
| 54 | Air cushion |
| 56 | Step |

What is claimed is:

1. A hand power tool, comprising a striking mechanism (10) that has a striker (32) and a drivable pot-type piston (12) with at least one idle opening (14) which in an open position prevents undesired build-up of a compressed air cushion, wherein the idle opening (14) is capable of being closed via a controllable, separate closing element (16) which is separate from the striker (32), wherein the closing element (16) during a working movement of the pot-type piston (12) in an actuating direction of the pot-type piston (12) is moved together with the pot-type piston (12).

2. The hand power tool according to claim 1, wherein the closing element (16) is moved together with the pot-type piston (12) in a direction of operation of the pot-type piston (12).

3. The hand power tool according to claims 1, wherein the closing element (16) is mechanically controlled.

4. The hand power tool according to claim 3, wherein the closing element (16) is loaded via a spring element (18) in a direction of its closed position, and the closing element (16) is capable of being moved into an opened position by means of a mechanical indexing device (20).

5. The hand power tool according to claim 4, wherein the closing element (16) is fastened to the spring element (18).

6. The hand power tool according to claim 4, wherein the indexing device (20) has an indexing element (22) along which the closing element (16) is guided when the idle opening (15) is open and, as a result, is held in an open position.

7. The hand power tool according to claim 6 wherein the indexing element (22) is supported such that it is displaceable in a direction of operation of the pot-type piston (12) against a spring force of a spring element (24).

8. The hand power tool according to claim 1, wherein the closing element (16) is made of a flexible material.

9. A hand power tool, comprising a striking mechanism (10) that has a drivable pot-type piston (12) with at least one idle opening (14), wherein the idle opening (14) is capable of being closed via a controllable, separate closing element (16), wherein the closing element (16) is loaded via a spring element (18) in a direction of a closed position, and the closing element (16) is capable of being moved into an open position by means of a mechanical indexing device (20), wherein the mechanical indexing device (20) has an indexing element (22) along which the closing element (16) is guided when the idle opening (15) is open and, as a result, is held in the open position, wherein the mechanical indexing element (22) is displaceable radially in relation to the pot-type piston (12) via at least one adjusting element (42, 50) and, as a result, the closing element (16) is capable of being controlled.

10. A hand power tool, comprising a striking mechanism (10) that has a drivable pot-type piston (12) with at least one idle opening (14), wherein the idle opening (14) is capable of being closed via a controllable, separate closing element (16), wherein the closing element (16) is loaded via a spring element (18) in a direction of a closed position, and it is capable of being moved into an open position by means of a mechanical indexing device (20), wherein the mechanical indexing device (20) has an indexing element (22) along which the closing element (16) is guided when the idle opening (15) is open and, as a result, is held in the open position, wherein the indexing element (22) is supported such that it is displaceable in the direction of operation of the pot-type piston (12) against a spring force of a spring element (24), wherein the movement of the mechanical indexing element (22) is supported via roller bearings (44, 52).

* * * * *